US010605557B2

(12) United States Patent
Göggel

(10) Patent No.: US 10,605,557 B2
(45) Date of Patent: Mar. 31, 2020

(54) INTEGRAL SOUND SUPPRESSOR FOR A GUN BARREL

(71) Applicant: L&O Hunting Group GmbH, Isny (DE)

(72) Inventor: Fabian Göggel, Isny (DE)

(73) Assignee: L&O Hunting Group GmbH, Isny (DE)

( * ) Notice: Subject to any disclaimer, the term of this patent is extended or adjusted under 35 U.S.C. 154(b) by 0 days.

(21) Appl. No.: 15/902,052

(22) Filed: Feb. 22, 2018

(65) Prior Publication Data

US 2018/0245871 A1 Aug. 30, 2018

(30) Foreign Application Priority Data

Feb. 28, 2017 (DE) ..... 10 2017 104 088

(51) Int. Cl.
*F41A 21/00* (2006.01)
*F41A 21/30* (2006.01)
*F41A 21/36* (2006.01)

(52) U.S. Cl.
CPC ..... *F41A 21/30* (2013.01); *F41A 21/36* (2013.01)

(58) Field of Classification Search
CPC ..... F41A 21/30; F41A 21/36; F41A 21/38
See application file for complete search history.

(56) References Cited

U.S. PATENT DOCUMENTS 1,111,202 A * 9/1914 Westfall ..... F41A 21/30 181/223
3,399,597 A * 9/1968 Perrine ..... F41A 21/30 89/14.4
3,713,362 A * 1/1973 Charron ..... F41A 21/30 89/14.4
3,776,093 A 12/1973 Leverance et al.
4,907,488 A * 3/1990 Seberger ..... F41A 21/30 181/223

(Continued)

FOREIGN PATENT DOCUMENTS

CA 2913248 A1 * 5/2017 ..... F41A 21/30
DE 108352 A 2/1899

(Continued)

OTHER PUBLICATIONS

Result of Examination Report for DE 10 2017 104 088.9 filed Feb. 28, 2017.
European Search Report dated Jun. 20, 2018 for EP18153364.

*Primary Examiner* — Gabriel J. Klein
(74) *Attorney, Agent, or Firm* — Paul D. Bianco; Katharine Davis; Fleit Intellectual Property Law

(57) ABSTRACT

An integral sound suppressor for a gun barrel, with the integral sound suppressor including a tubular housing designed for nearly completely or completely encasing the gun barrel along its longitudinal direction with an internal thread disposed inside the housing for mounting the integral sound suppressor on an external thread disposed on the muzzle of the gun barrel. Disposed inside the housing is a deflector system for deflecting the gas generated by firearm discharge, and disposed on the housing is a guide surface which is spaced at a distance from the internal thread along the longitudinal direction of the housing for guiding the integral sound suppressor in the region of the front end of the gun barrel.

16 Claims, 4 Drawing Sheets

(56) References Cited

U.S. PATENT DOCUMENTS

| | | | | |
|---|---|---|---|---|
| 5,753,846 | A * | 5/1998 | Koon | F41A 21/28 42/75.02 |
| 7,789,008 | B2 * | 9/2010 | Petersen | F41A 21/30 89/14.4 |
| D685,874 | S * | 7/2013 | Andrews, Jr. | D22/108 |
| 8,528,691 | B1 * | 9/2013 | Carmichael | F41A 21/30 181/223 |
| 8,627,755 | B1 | 1/2014 | Eckel | |
| 9,103,618 | B2 * | 8/2015 | Daniel | F41A 21/325 |
| 2010/0180759 | A1 | 7/2010 | Petersen | |
| 2012/0152649 | A1 * | 6/2012 | Larue | F41A 21/36 181/223 |
| 2015/0090105 | A1 | 4/2015 | Pace | |
| 2015/0136519 | A1 | 5/2015 | Moore | |
| 2016/0003570 | A1 * | 1/2016 | Tonkin | F41A 21/02 89/14.4 |
| 2016/0161203 | A1 | 6/2016 | Wilson | |
| 2017/0115084 | A1 * | 4/2017 | Hailey | F41A 21/28 |
| 2017/0190779 | A1 * | 7/2017 | Martin | A61K 31/7052 |
| 2017/0299291 | A1 * | 10/2017 | Spector | F41G 11/003 |

FOREIGN PATENT DOCUMENTS

| | | | | |
|---|---|---|---|---|
| EP | 3023729 | A1 * | 5/2016 | F41A 21/30 |
| EP | 3023729 | A1 | 5/2016 | |
| GB | 2355056 | A | 4/2001 | |
| RU | 2066037 | C1 | 8/1996 | |
| WO | 00/57122 | A1 | 9/2000 | |

* cited by examiner

INTEGRAL SOUND SUPPRESSOR FOR A GUN BARREL

FIELD OF THE INVENTION

The present invention relates to an integral sound suppressor for a gun barrel.

BACKGROUND

The distinguishing feature of integral sound suppressors for guns is that they are not only mounted on the muzzle of the barrel but extend nearly completely or, optionally, completely along the longitudinal direction of the gun barrel, and encase said barrel like a jacket. This type of design not only optimizes the sound suppressing effectiveness, but also improves the balance of the gun and its visual appearance.

This type of integral sound suppressor is known from GB 2 355 056 A. This sound suppressor comprises a tubular housing designed for encasing the gun barrel along its longitudinal direction, which housing is mounted on a gun barrel and attached via an internal thread to an external thread disposed in the area of the muzzle of the gun barrel. In the area of the front end of the barrel, an annular adapter with a valve assembly for injecting a sound suppressing medium, e.g., in the form of an inert or noble gas, is clamped between the rearward end of the tubular housing and a shoulder on the gun barrel. Via the adapter, the sound suppressing medium contained in a cartridge can be injected into the barrel and into the housing of the integral sound suppressor which is screwed onto the barrel. Injecting the sound suppressing medium into the firearm results in a decrease in the volume of combustible gas within the firearm and thereby reduces the muzzle blast. However, this solution to the problem requires a relatively high degree of constructional complexity. In addition, the adapter must be actuated separately, and an additional sound suppressing medium is required.

SUMMARY

The disclosure relates to an integral sound suppressor of the type mentioned above, which is optimally guided and mounted on the gun barrel and which enables the most effective and simplest possible reduction of undesirable side effects generated by firearm discharge at little expense and effort.

Useful embodiments and advantageous advanced modifications are also disclosed.

Inside the housing which nearly completely or completely encases the gun barrel along its longitudinal direction, a deflector system for deflecting the gas generated by firearm discharge is disposed in the integral sound suppressor according to the present invention. In addition, a guide surface is also disposed on the housing, at a distance from the internal thread, along the longitudinal direction of the housing, for guiding the integral sound suppressor in the area of a front barrel end of the gun barrel. This allows the integral sound suppressor to be easily slipped onto the barrel and to be mounted on the barrel free from stresses and without any perceptible transitions. Thus, the integral sound suppressor can be especially well-incorporated into the design of the gun without impairing the overall esthetic impression of the gun. The integral sound suppressor does not look like an accessory part, but rather gives the impression that the barrel is thicker. As a result, the characteristics of the gun can be maintained, such as handling, the center of gravity, the vibrational behavior and the balance. In the area of the base of the barrel, the integral sound suppressor is axially guided via the guide surface and is held in place on the muzzle of the barrel by means of the internal thread which mates with a standard thread. For maintenance and cleaning operations, the integral sound suppressor can be easily detached and subsequently easily remounted on the gun barrel. The gun can also be used as a regular hunting weapon without a sound suppressor. In this case, different barrel attachments, muzzle flash suppressors, muzzle covers or the like can be screwed onto the standard thread on the muzzle of the barrel.

In a preferred embodiment, the deflector system is formed by a baffle arrangement which is disposed inside the housing and/or by a muzzle brake which is disposed inside the housing. The baffle arrangement allows the flow of the gas exiting from the muzzle of the barrel upon firearm discharge to be slowed down, and prevents the volume of gas from suddenly escaping into the air. Thus, the gas which expands after a firearm discharge can expand inside the integral sound suppressor, thereby reducing the sound energy emitted into the environment. Using a muzzle brake that is disposed inside the housing in addition to the baffle arrangement or instead of the baffle arrangement, the combustible gas exiting from the muzzle of the barrel upon firearm discharge can also be deflected and directed into an expansion chamber toward the rear. As a result, the energy of the combustible gas can be reduced as well. In addition, the recoil can be reduced by the gas, which is directed toward the rear, and by the counterforces generated thereby.

An inner tube designed for receiving the gun barrel is disposed in an especially useful manner inside the housing, which inner tube, together with the housing, bounds an expansion chamber for receiving the gas that is generated by firearm discharge. The inner tube shields the gun barrel, thereby protecting it from the gas directed into the expansion chamber.

In an especially useful structural configuration, the inner tube can be held in place on one end by the muzzle brake and on the other end by a guide bushing inside the tubular housing. The guide bushing is preferably inserted into the rearward end of the housing, which faces the front end of the barrel, and preferably has a guide surface designed for axially guiding the integral sound suppressor in the area of a front end of the barrel.

In a useful configuration, the internal thread for mounting the integral sound suppressor on an external thread disposed on the muzzle of the gun barrel can be disposed on the muzzle brake. A gap is preferably provided inside the housing between the baffle arrangement and the muzzle brake. Because of this gap, stresses can be avoided.

In another useful configuration, the tubular housing of the integral sound suppressor can fit inside an outer sleeve. The outer sleeve is designed so that it has the same outside diameter as the wider diameter of the front end of the barrel. This ensures that the barrel with the integral sound suppressor mounted thereon has a uniform profile.

The baffle arrangement can consist of a main body having a plurality of chambers which, in the longitudinal direction, are spaced at a distance from each other and separated from each other by dividers, on two opposite sides of which openings are disposed. The muzzle brake preferably has radial through-openings for deflecting the gas generated by firearm discharge into the expansion chamber formed between the housing and the inner tube.

BRIEF DESCRIPTION OF THE DRAWINGS

Other features and advantages of the present invention will become apparent from the description of a preferred embodiment with reference to the drawing. The figures show.

DETAILED DESCRIPTION

Figure 1:
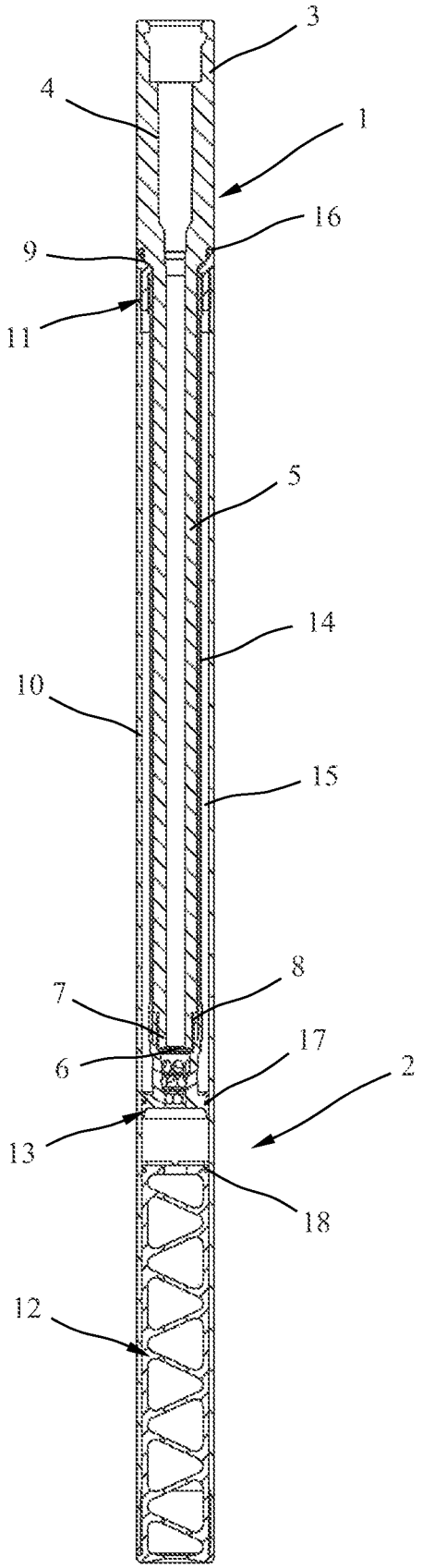
FIG. 1 a longitudinal section through a gun barrel with an integral sound suppressor.

FIG. 1 shows a gun barrel 1 with an integral sound suppressor 2 which encases the gun barrel 1 along nearly the entire length thereof. The gun barrel 1, which is also separately shown in FIG. 2, comprises a front barrel end 3 having a wider diameter with a cartridge chamber 4 and a barrel section 5 having a smaller diameter, which is traversed by the projectile upon discharge of the firearm. The gun barrel 1 comprises a barrel muzzle 6 on a rearward end 7 of the barrel. On the rearward end 7 of the gun barrel 1, an external thread 8 for mounting the integral sound suppressor 2 is provided. In the transition from the front barrel end 3 having a wider diameter to the more slender barrel section 5, there is a cylindrical outer guide surface 9 for guiding the integral sound suppressor 2 in the area of the front barrel end 3.

Figure 4:
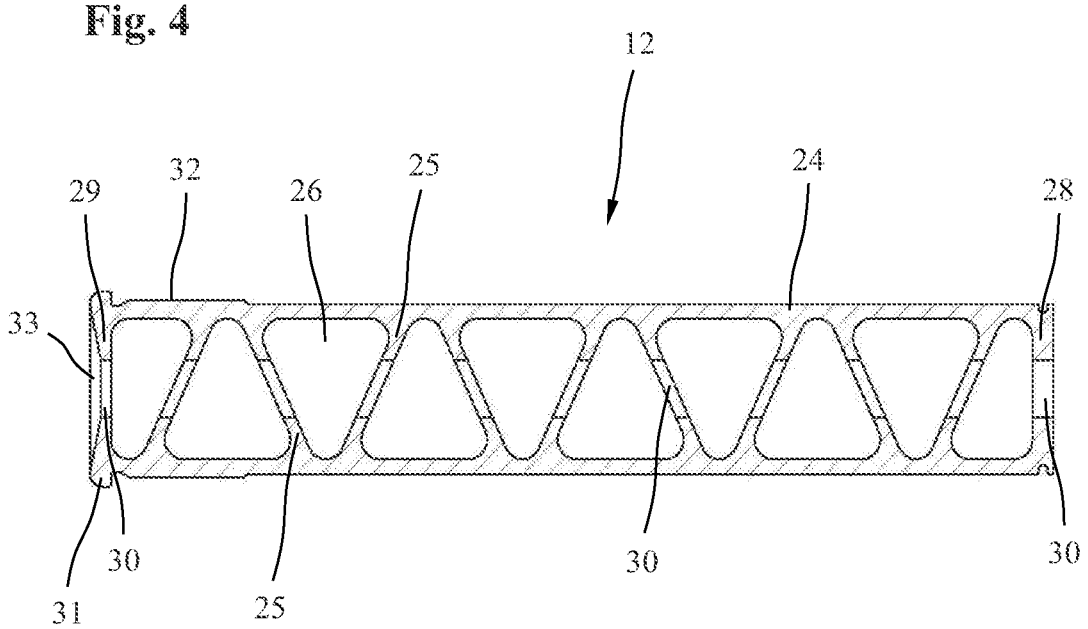
FIG. 4 a longitudinal section through a baffle arrangement of the integral sound suppressor shown in FIG. 1.
Figure 5:
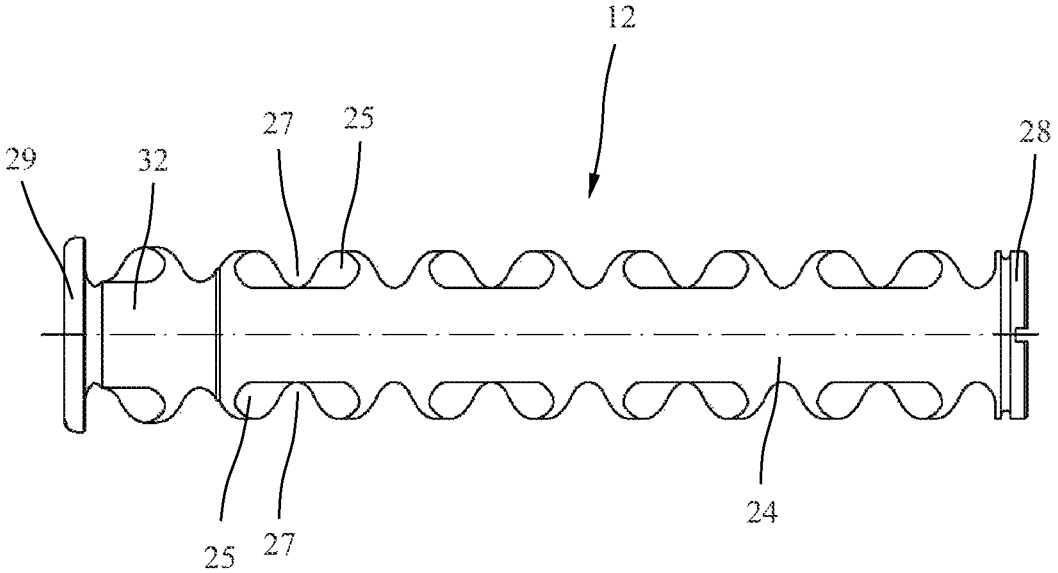
FIG. 5 a perspective view of the baffle arrangement shown in FIG. 4.
Figure 6:
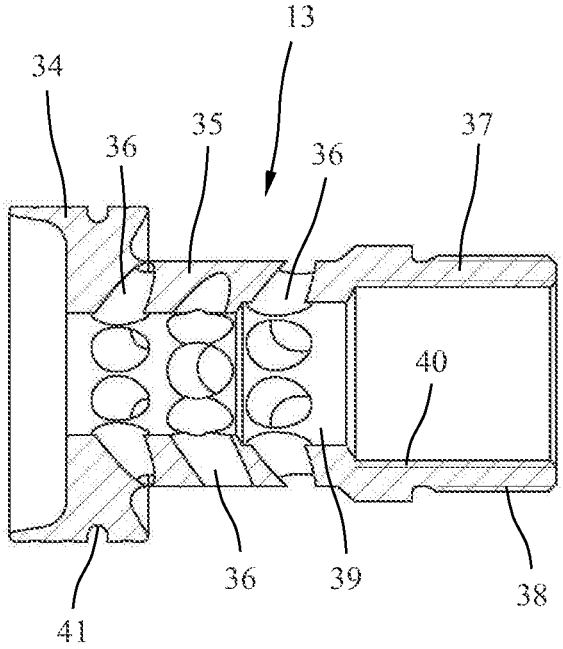
FIG. 6 a longitudinal section through a muzzle sound suppressor of the integral sound suppressor shown in FIG. 1 and FIG. 7 a perspective view of the muzzle sound suppressor shown in FIG. 6.
Figure 7:
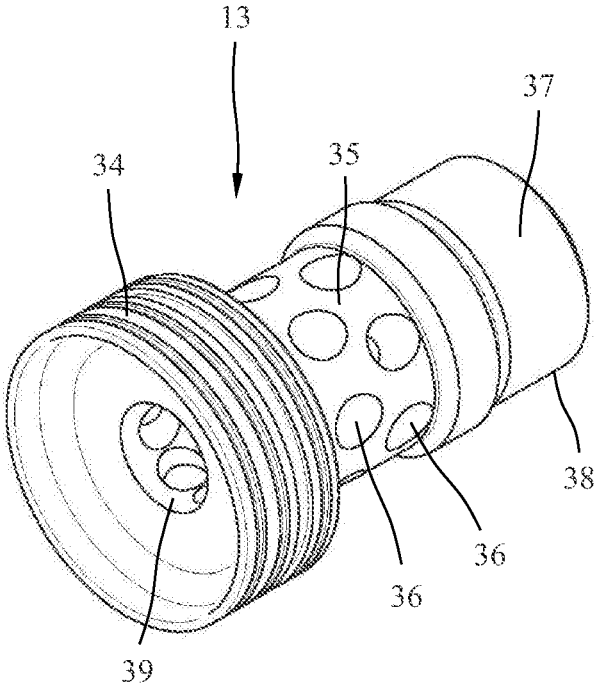

The integral sound suppressor 2 shown in FIG. 1 comprises a tubular housing 10 designed so as to nearly completely encase the gun barrel 1 along its longitudinal direction, the outside diameter of which housing corresponds to the outside diameter of the front barrel end 3. The tubular housing 10 has a length that is greater than the length of the overall gun barrel 1 and is designed so that it encases the barrel section 5 of the gun barrel 1 traversed by the projectile upon discharge of the firearm along the entire length thereof. On its rearward end facing the front barrel end 3, the tubular housing 10 of the integral sound suppressor 2 comprises a guide bushing 11, which is shown separately in FIG. 3. Inserted into the forward end of the tubular housing 10, as seen when looking in the downrange direction, is a baffle arrangement 12, which is shown in FIGS. 4 and 5. In addition, a muzzle brake 13 shown in FIGS. 6 and 7 is disposed inside the housing 10 between the guide bushing 11 and the baffle arrangement 12. To avoid stresses, a gap is provided between the baffle arrangement 12 and the muzzle brake 13 inside the housing 10. Also disposed between the guide bushing 11 and the muzzle brake 13 in the tubular housing 10 is an inner tube 14 designed for receiving the gun barrel 1 and concentrically arranged with respect to the housing 10. Bounded between the tubular housing 10 and the inner tube 14 is an expansion chamber 15 with an annular cross section.

Inside the housing 10, one end of the inner tube 14 is held in place by the guide bushing 11 and the other end by the muzzle brake 13. To this end, both the guide bushing 11 and the muzzle brake 13 each have a thread for mating with a corresponding counter thread on both ends of the inner tube 14. On both ends, the expansion chamber 15 formed between the housing 10 and the inner tube 14 is bounded by the guide bushing 11 and the muzzle brake 13. A seal 16 seals off the guide bushing 11 from the gun barrel 1. The muzzle brake 13 is sealed off from the housing 10 by means of a seal 17. A seal 18 is also disposed on the baffle arrangement 12 so as to seal off the housing 10.

Figure 2:
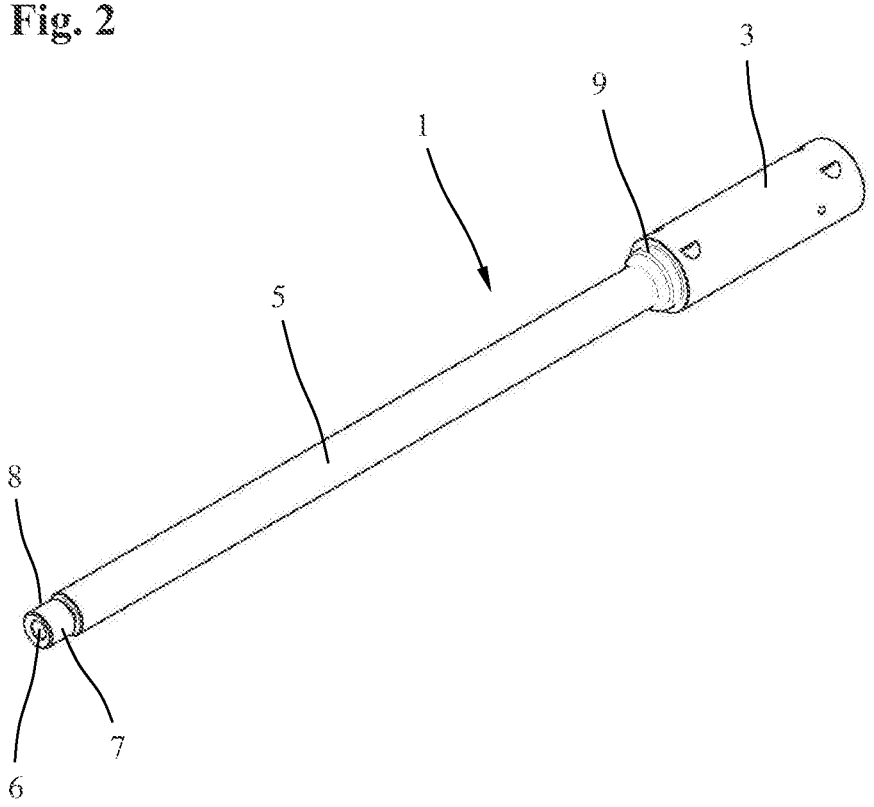
FIG. 2 a perspective view of a gun barrel.
Figure 3:
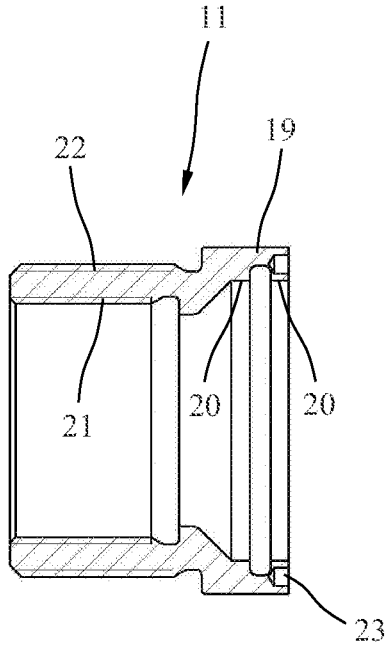
FIG. 3 a longitudinal section through a guide bushing of the integral sound suppressor shown in FIG. 1.

As FIG. 3 indicates, the guide bushing 11 comprises an annular cuff 19 with a cylindrical inner guide surface 20 for making contact with the cylindrical outer guide surface 9 of the gun barrel 1, as shown in FIG. 2. Disposed on the inner surface of the guide bushing 11 is an internal thread 21 for connecting the guide bushing to the inner tube 14. In addition, the guide bushing 11 also has an external thread 22, via which the guide bushing 11 is screwed into a corresponding internal thread on the end of the tubular housing 10, which end is oriented toward the front barrel end 3. In the front face wall of the guide bushing 11 facing the front barrel end 3, a circumferential annular groove 23 is disposed for receiving the seal 16 shown in FIG. 1.

The baffle arrangement 12 shown in FIGS. 4 and 5 consists of a main body 24 having a plurality of chambers 26 which, in the longitudinal direction, are spaced at a distance from each other and which are separated from each other by dividers 25, on two opposite sides of which openings 27 are disposed. The dividers 25 sequentially disposed one next to the other in the longitudinal direction of the baffle arrangement 12 between a back face wall 28 and a front face wall 29 of the main body 24 are each inclined in opposite directions so that the chambers 26 have a triangular shape. In the back face wall 28, the front face wall 29 and in the dividers 25, central through-openings 30 are disposed for creating a through-channel matched to the caliber of the projectile passing through. In the area of the front face wall 28, a shoulder 31 and an external thread 32 are disposed on the outside surface of the main body 24, by means of which external thread the main body 24 can be screwed into the tubular housing 10. In the front face surface of the front face wall 28, a depression 33 for conducting the pressure wave away from the person shooting the gun is provided. The baffle arrangement 12 slows down the flow of the gas exiting from the muzzle 6 of the barrel when the firearm is discharged and prevents the gas volume from suddenly escaping into the air. This allows the gas which expands after discharge of the firearm to expand inside the integral sound suppressor 2 so that the sound energy emitted into the environment can be reduced.

In the embodiment shown, the baffle arrangement 12 is produced in a part, e.g., by cutting or machining, from a cylindrical main body made of a high-tensile and heat-resistant light-weight metal. However, the baffle arrangement 12 can also be configured differently and be produced by means of a different method.

The muzzle brake 13 shown in FIGS. 6 and 7 consists of a hollow cylindrical main component which comprises a guiding region 34 having a wider diameter for guiding the muzzle brake in the tubular housing 10, a more slender intermediate area 35 with radial through-openings 36, and a clamping area 37 with an external thread 38 for connecting the muzzle brake to the inner tube 14. The through-openings 36 are configured in such a way that they lead from a central through-opening 39 to the outside of the more slender intermediate area 35. This allows the combustible gases generated by firearm discharge to be channeled into the expansion chamber 15 formed between the tubular housing 10 and the inner tube 14 and to be directed toward the rear. Because of the resulting counterforces, the recoil can be reduced. In the embodiment shown, the radial through-openings 36 are obliquely oriented toward the rear. In this manner, the deflection obtained is especially effective.

As FIG. 6 indicates, an internal thread 40 for attaching the integral sound suppressor 2 to the gun barrel 1 is disposed on the inside surface of the clamping area 37 of the muzzle brake 13. By means of this internal thread 40, the integral sound suppressor 2 can be screwed onto external thread 8 in the area of the front barrel end 3, which external thread 8 can also be used for mounting other muzzle attachments. The guide bushing 11 axially guides the integral sound suppressor 2 on the gun barrel 1. Disposed on the outside surface of the guiding region 34 is a groove 41 for the seal 17 provided for radially sealing off the muzzle brake 13 from the housing 10.

LIST OF REFERENCE NUMBERS

1 Gun barrel
2 Integral sound suppressor
3 Front barrel end
4 Cartridge chamber
5 Barrel section
6 Muzzle of the barrel
7 Rearward end of the barrel
8 External thread
9 Cylindrical outer guide surface
10 Tubular housing
11 Guide bushing
12 Baffle arrangement
13 Muzzle brake
14 Inner tube
15 Expansion chamber
16 Seal
17 Seal
18 Seal
19 Annular cuff
20 Cylindrical inner guide surface
21 Internal thread
22 External thread
23 Annular groove
24 Main body
25 Divider
26 Chamber
27 Opening
28 Back face wall
29 Front face wall
30 Through-opening
31 Shoulder
32 External thread
33 Depression
34 Guiding region
35 Intermediate area
36 Through-openings
37 Clamping area
38 External thread
39 Through-opening
40 Internal thread
41 Groove

The invention claimed is:

1. A suppressor for a barrel of a firearm, the barrel having a cartridge chamber at a first end and a muzzle at a second end, the suppressor comprising:

a tubular housing configured and dimensioned for encasing the barrel along a longitudinal length thereof, the tubular housing extending from the cartridge chamber to beyond the muzzle;

an internal thread disposed within an interior of the tubular housing, the internal thread configured and dimensioned for engaging an external thread disposed on the muzzle of the barrel, thereby threadably connecting the suppressor with the barrel;

a deflector system disposed within the tubular housing, the deflector system deflecting gas generated by discharge of the firearm;

an inner tube disposed concentrically within the tubular housing and configured and dimensioned to receive the barrel;

an expansion chamber bounded between the tubular housing and the inner tube, the expansion chamber receiving the gas generated by discharge of the firearm to prevent the gas from contacting an exterior of the barrel; and a guide surface disposed on the tubular housing and spaced at a distance from the internal thread along the longitudinal length of the barrel, the guide surface configured to guide the suppressor at the first end of the barrel, wherein the tubular housing has an outer diameter equal to a diameter of the first end of the barrel such that the barrel with the suppressor mounted thereon has a uniform profile.

2. The suppressor according to claim 1, wherein the inner tube extends with the tubular housing from the cartridge chamber to beyond the muzzle.

3. The suppressor according to claim 1, wherein the deflector system comprises at least one of a baffle arrangement and a muzzle brake, the baffle arrangement configured for slowing a flow of gas exiting from the muzzle on discharge of the firearm and the muzzle brake configured for deflecting and directing the gas exiting from the muzzle on discharge of the firearm into the expansion chamber.

4. The suppressor according to claim 3, wherein the deflector system comprises the muzzle brake and the internal thread is disposed on the muzzle brake.

5. The suppressor according to claim 3, wherein the deflector system comprises the baffle arrangement and the muzzle brake, the baffle arrangement separated from the muzzle brake by a gap.

6. The suppressor according to claim 3, wherein the deflector system comprises the baffle arrangement, the baffle arrangement including a main body having a plurality of chambers spaced apart from each other in a longitudinal direction and separated by a plurality of dividers.

7. The suppressor according to claim 6, wherein each divider of the plurality of dividers has an opening on two opposing sides and a central through opening and is inclined in an opposite direction to adjacent dividers such that each chamber of the plurality of chambers has a shape of a triangle.

8. The suppressor according to claim 3, wherein the deflector system comprises the muzzle brake, the muzzle brake including radial through openings for deflecting and directing the gas exiting from the muzzle on discharge of the firearm into the expansion chamber.

9. The suppressor according to claim 8, wherein the radial through openings are obliquely oriented in a direction toward a rear of the barrel.

10. A suppressor for a barrel of a firearm, the barrel having a cartridge chamber at a first end and a muzzle at a second end, the suppressor comprising:

a tubular housing configured and dimensioned for encasing the barrel along a longitudinal length thereof, the tubular housing extending from the cartridge chamber to beyond the muzzle;

an internal thread disposed within an interior of the tubular housing, the internal thread configured and dimensioned for engaging an external thread disposed on the muzzle of the barrel, thereby threadably connecting the suppressor with the barrel;

a deflector system disposed within the tubular housing, the deflector system deflecting gas generated by discharge of the firearm;

an inner tube disposed concentrically within the tubular housing and configured and dimensioned to receive the barrel;

an expansion chamber bounded between the tubular housing and the inner tube, the expansion chamber receiving the gas generated by discharge of the firearm to prevent the gas from contacting an exterior of the barrel;

an annular guide bushing disposed at a first end of the inner tube proximate the first end of the barrel, the annular guide bushing configured and dimensioned to hold the inner tube in place and to guide the suppressor at the first end of the barrel; and an inner cylindrical guide surface disposed within the annular guide bushing and configured for engaging an outer cylindrical guide surface on the exterior of the barrel, wherein the tubular housing has an outer diameter equal to a diameter of the first end of the barrel such that the barrel with the suppressor mounted thereon has a uniform profile.

11. The suppressor according to claim 10, wherein the inner tube extends with the tubular housing from the cartridge chamber to beyond the muzzle.

12. The suppressor according to claim 10, wherein the deflector system comprises at least one of a baffle arrangement and a muzzle brake, the baffle arrangement configured for slowing a flow of gas exiting from the muzzle on discharge of the firearm and the muzzle brake configured for deflecting and directing the gas exiting from the muzzle on discharge of the firearm into the expansion chamber.

13. The suppressor according to claim 12, wherein the deflector system comprises the muzzle brake, the muzzle brake disposed at a second end of the inner tube proximate the second end of the barrel and configured and dimensioned to hold the inner tube in place.

14. The suppressor according to claim 12, wherein the deflector system comprises the baffle arrangement and the muzzle brake, the baffle arrangement separated from the muzzle brake by a gap.

15. The suppressor according to claim 12, wherein the deflector system comprises the baffle arrangement, the baffle arrangement including a main body having a plurality of chambers spaced apart from each other in a longitudinal direction and separated by a plurality of dividers.

16. The suppressor according to claim 12, wherein the deflector system comprises the muzzle brake, the muzzle brake including radial through openings for deflecting and directing the gas exiting from the muzzle on discharge of the firearm into the expansion chamber.

* * * * *